US006282724B1

(12) United States Patent
Abraham et al.

(10) Patent No.: US 6,282,724 B1
(45) Date of Patent: Sep. 4, 2001

(54) APPARATUS FOR ENHANCING ABSORPTION AND DISSIPATION OF IMPACT FORCES FOR ALL HELMETS AND PROTECTIVE EQUIPMENT

(75) Inventors: Carl J. Abraham, Great Neck, NY (US); Henry D. Cross, Murrells Inlet, SC (US)

(73) Assignees: Carl Joel Abraham; Henry D. Cross, III, both of Great Neck, NY (US)

( * ) Notice: Subject to any disclaimer, the term of this patent is extended or adjusted under 35 U.S.C. 154(b) by 0 days.

(21) Appl. No.: 09/790,248

(22) Filed: Feb. 21, 2001

(51) Int. Cl.[7] ..... A42B 3/00
(52) U.S. Cl. ..... 2/412; 2/267; 2/414; 2/455
(58) Field of Search ..... 2/267, 268, 455, 2/414, 412, 411, 24, 22, 20, 909

(56) References Cited

U.S. PATENT DOCUMENTS

| | | | |
|---|---|---|---|
| 2,785,407 | * | 3/1957 | Reeder . |
| 3,174,155 | * | 3/1965 | Pitman . |
| 3,248,738 | * | 5/1966 | Morgan . |
| 3,577,562 | * | 5/1971 | Holt . |
| 4,136,226 | * | 1/1979 | Gilman . |
| 4,370,754 | | 2/1983 | Donzis . |
| 4,375,108 | | 3/1983 | Gooding . |
| 4,561,123 | * | 12/1985 | Hull . |
| 4,700,403 | * | 10/1987 | Vacanti . |
| 4,937,888 | | 7/1990 | Straus . |
| 4,985,931 | | 1/1991 | Wingo . |
| 5,054,121 | | 10/1991 | Mitchell . |
| 5,187,812 | * | 2/1993 | Neuhalfen . |
| 5,274,846 | | 1/1994 | Kolsky . |
| 5,361,410 | * | 11/1994 | Sigl . |
| 5,713,082 | | 2/1998 | Bassette . |
| 5,722,093 | * | 3/1998 | Andresen . |
| 5,732,414 | * | 3/1998 | Monica . |
| 5,781,935 | * | 7/1998 | Bassett et al. . |
| 5,836,015 | * | 11/1998 | Kristensen et al. . |
| 5,881,395 | * | 3/1999 | Donzis . |
| 5,918,310 | * | 7/1999 | Farahany . |
| 5,947,918 | | 9/1999 | Jones . |
| 6,093,468 | | 7/2000 | Toms . |

* cited by examiner

*Primary Examiner*—Rodney M. Lindsey

(57) ABSTRACT

An apparatus for enhancing absorption and dissipation of impact forces for all helmets and protective equipment. More particularly, the invention is a series of detachable pre-formed pads that each include a rigid or semi-rigid insert for enhanced protection and effectiveness. In one mode of production, at least one rigid or semi-rigid layer is located within the pad, or covered by pliable pad material on all sides. In a second mode, at least one rigid member or semi-rigid appears on the exterior surface of the pad, with pliable materials located beneath. In still another mode, at least one rigid or semi-rigid member appears on the interior surface of the pad, providing great versatility to the manufacturer or user. As such, the device is specifically designed to improve the absorption and dissipation of primary forces directly into items such as a plurality of previously existing pads and chest protectors, as well as to the shell of helmets.

20 Claims, 2 Drawing Sheets

APPARATUS FOR ENHANCING ABSORPTION AND DISSIPATION OF IMPACT FORCES FOR ALL HELMETS AND PROTECTIVE EQUIPMENT

BACKGROUND OF THE INVENTION

1. Field of the Invention

The present invention is an apparatus for enhancing absorption and dissipation of impact forces for all helmets and protective equipment. More particularly, the invention is a series of detachable pre-formed pads that each include a rigid or semi-rigid insert for enhanced protection and effectiveness. In one mode of production, at least one rigid or semi-rigid layer is located within the pad, or covered by pliable pad material on all sides. In a second mode, at least one rigid member or semi-rigid appears on the exterior surface of the pad, with pliable materials located beneath. In still another mode, at least one rigid or semi-rigid member appears on the interior surface of the pad, providing great versatility to the manufacturer or user.

As such, the device is specifically designed to improve the absorption and dissipation of primary forces directly into items such as a plurality of previously exiting pads and chest protectors, as well as to the shell of helmets, as disclosed in a co-pending application by one co-applicant of the present invention.

2. Description of the Prior Art

Numerous innovations for protective devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,093,468 , Invented by Toms et al., Entitled "Flexible Lightweight Protective Pad With Energy Absorbing Inserts"

The patent to Toms et al., is an improved protective pad for protecting the human body against impact forces. The pad is formed using layers of high density closed-cell polymer foam low density closed-cell polymer foam, and resilient or non-resilient energy absorbing inserts. The high density layer absorbs and shunts impact forces, while the low density layer acts as a cushion against the human body, and provides for comfort. The pad can be provided with a plurality of holes through its thickness to provide for breathability and release of heat from the human body, the surface area of the holes being great enough to allow for adequate ventilation but not so great as to significantly decrease the protection offered by the pad. The pad can also be provided with a plurality of score lines across its surface and partially through its thickness to provide for flexibility and conformability to the part of the human body being protected.

2. U.S. Pat. No. 5,361,410, Invented by Sigi, Entitled "Padding Device For Protecting The Human Body Against Impact"

In the patent to Sigi, a device for protecting the human body against impacts and blows is provided that may be used integral with a garment or separately. The device consists of a hard core material and a padding part which further comprises a foam material with closed parts wherein the hard core material and padding part have perforations in a predesigned configuration. The padding part may also be equipped with a functional lining that is water vapor permeable, windproof and waterproof. These devices are particularly useful as a protective insert in sports uniforms and protective helmets and may also be used as a splinting device such as a cast.

3. U.S. Pat. No. 5,947,918, Invented by Jones et al., Entitled "Impact Energy Absorbing Composite Materials"

In the patent to Jones, et al., an impact energy absorbing composite material of expanded polytetrafluoroethylene (ePTFE) and an elastomer is disclosed. The composite is comprised of at least one layer of expanded polytetrafluoroethylene and at least one layer of an elastomer. The individual layer thicknesses of the ePTFE and elastomer are controlled to achieve superior high energy impact resistance. The invention herein provides a material having performance that also can be tailored to meet other design needs for a given application, for example, space considerations or comfort.

4. U.S. Pat. No. 4,375,108, Invented by Gooding, Entitled "Energy-Absorbing Insert For Protective Headgear"

The Gooding invention describes an ancillary multi-chambered fluid-filled cushion for use as an energy-absorbing insert on the inside of protective headgear of the type having an outer helmet shell and a flexible inner liner. The chambers may be distinct or may be interconnected by means of communicating passages which control the flow of fluid between chambers. The chamber and communicating passages are formed of resilient material bonded together at perimeter flanges which may be engageable with the helmet inner liner so as to hold the cushion in place. The cushion is aligned intermediate the wearer's head and the outer shell, between existing inner liner components, so as to provide partial support of the helmet shell.

5. U.S. Pat. No. 5,274,846, Invented by Kolsky, Entitled "Cushion Having Multilayer Closed Cell Structure"

The patent to Kolsky describes a cushion or pad comprising a first layer of a first synthetic cellular material having a first average cell volume and a second layer of a second synthetic cellular material having a second average cell volume at least ten times greater than the first average cell volume. The first layer is attached to the second layer so that the first layer and the second layer at least partially overlap one another to form a multilayer structure. The layer with the larger average cell volume is a polymeric sheet with at least a substantially planar array of fluid-filled pockets or chambers. The layer with the smaller average cell volume is a foam material with either open cells or closed cells. Further layers of fluid-filled chambers or foam material may be attached to the first two layers.

6. U.S. Pat. No. 5,054,121, Invented by Mitchell, Entitled "Athletic Pad"

The patent to Mitchell describes a protective pad for body parts comprising an elongate protective outer plate of a substantially stiff but flexible material having a concave inner surface, and an inner ply of padding extending across the inner surface of the plate. A closed loop of stitching secures the inner ply to the marginal edges of the inner surface of the outer plate to suspend the inner ply taut and spaced inwardly from the central portion of the inner surface of the plate.

7. U.S. Pat. No. 4,985,931, Invented by Wingo, Jr., Entitled "Shock Absorbing Pad Structure For Athletic Equipment"

The patent to Wingo, Jr. describes a shock absorbing pad structure for athletic equipment, such as shoulder pads, has a foam member, having an undulated configuration formed by a plurality of elevations and depressions, arranged in a staggered relationship with respect to one another, disposed within a flexible, substantially air impermeable enclosure. The flexible enclosure has at least one air permeable portion disposed therein.

8. U.S. Pat. No. 4,700,403 Invented by Vacanti, Entitled "Protective Cushion"

The patent to Vacanti describes a protective pad assembly usable primarily by athletes to protect body parts from injury, especially from traumatic shock as when struck by a high speed hockey puck. The pad assembly includes a relatively rigid outer shell or shield and an inner air entrained cushion releasably attached to the outer shell and closely conformable to the body part being protected. The cushion includes a flexible, shock absorbent pad covered by a flexible air impervious case. The pad is formed of a soft, springy material which expels air upon compression, such as polyurethane foam. Small openings in the case are provided for expulsion of air from the case upon deflection of the pad as under the influence of the force of impact of an external object. The amount and rate at which air is expelled from the case influences the resiliency and shock absorbency characteristics of the cushion.

9. U.S. Pat. No. 4,370,754 Invented by Donzis, entitled "Variable Pressure Pad"

The protective garment of the Donzis invention is for the shoulders, ribs, biceps, forearms, thighs, knees and shins. The garment is composed of variable pressure pads, air cushions, and/or shields. The pad includes two superimposed plies of a light-weight, non-elastic fluid-impervious fabric material having adjacent surfaces of the material sealed around the periphery to form a pressure tight inflatable garment and other adjacent surfaces sealed at regions internally of the periphery to define a plurality of fluid chambers and fluid passageways. The internal fluid chambers are communicable with adjacent chambers by means of the passageways. The material folds over at preselected regions to constrict communication between the chambers as an external force is applied. Air cushions in the form of a plurality of tubular air chambers are mounted on the variable pressure pads at certain critical locations to provide additional cushioning and dispersion of an external force over an area wider than the impact area.

10. U.S. Pat. No. 5,713,082, Invented by Bassette et al., Entitled "Sports Helmet"

The patent to Bassette et al. describes an improved helmet constructed with a rigid shell having a soft outer covering which absorbs impacts and disperses energy thereby protecting the wearer of the helmet, as well as protecting the impacting object. When used for contact sports such as football, this covering is effective in preventing injuries resulting when the helmet is used as a sting object. The covering may be applied in segmented pieces or as a continuous layer around the shell which forms a solid frame-like structure. A face mask can also be covered with soft, durable covering and be mounted in such a manner to allow the covering to act as a shock absorber against sliding of the mask due to external forces.

11. U.S. Pat. No. 4,937,888, Invented by Straus, Entitled "Helmet Cover"

The patent to Straus describes an apparatus for protecting the wearer of a helmet in the form of an elastomeric cellular helmet cover, encased in an integral shell of like material, that can be attached to the exterior of an unmodified helmet, by means of flexible tabs, to reduce the potential for injury to the wearer. The helmet cover is configured so that it is thicker in the area where impact is customarily greater, and greater resilience is provided at these points. The helmet cover is sufficiently thick at the front to protrude forward at the edge of the helmet and a face guard attaching parts. The wearer is therefore protected and those contacted by the helmet during the game are also protected.

Based on the above, the present invention is considered an improvement over the prior art, where rigid or semi-rigid inserts are not utilized, or where a pad insert is used in a substantially different context. For instance, the first-above listed patent to Toms illustrates a protective pad with high density and low density foam layers, as well as a rigid insert to provide strength at minimal bulk. However, such is primarily designed as a pad used in conjunction with a garment, to particularly protect the hips of an elderly person due to common breakage thereof. Permanently or removably attached to the garment, the Toms device is further designed to reduce perspiration buildup and allow the pad to "breathe" for user comfort.

In contrast to the above, the present invention teaches the usage of pre-formed detachable pads for helmets and all protective equipment, with each pad including a rigid or semi-rigid insert for enhanced protection and effectiveness. Importantly, at least one rigid or semi-rigid insert may be located within the pad, upon the exterior surface of the pad, or upon the interior surface of the pad, offering greater versatility than the prior art.

In preferred modes, the insert is a high-density polyethylene, low-density polyethylene, or semi-rigid material between one-sixteenth and three-quarter inches in thickness, dependent upon intended usage. The pre-formed pads that contain the insert may be placed in critical areas of all protective gear to improve absorption and dissipation of forces, for the utmost in user protection.

As noted above, such pre-formed pads may be adapted to all helmets and protective headgear, as described in a co-pending application by a co-applicant of the present invention, considered a further improvement over the prior art. For instance, the patent to Bassette shows a helmet with additional permanent padding along the entire exterior surface, as compared to detachable padding in critical areas only. In addition, the Bassette patent only teaches the usage of sectional-type padding due to the curvature of the helmet and ease of placement on such cursed surface. Moreover, the patent to Straus discloses a helmet with detachable padding, affixed by hook and loop in the preferred mode. However, such is embodied in a single-piece addition, that is specifically "molded to fit over the top part of a helmet" as noted in Straus Claim "1"(emphasis added). Additional prior art patents teach the usage of ancillary members to protect the helmet itself from scratches and cracks, as well as ancillary members utilized to decorate or enhance the appearance of the helmet.

In addition, such pads may be placed in other general, less-critical areas of the gear as well. Therefore, the pads enhance protection of many areas of the body, both at minimal cost and at a desired minimal weight.

SUMMARY OF THE INVENTION

It should be noted that about 300,000 sports-related concussions occur each year, with 100,000 occurring in the sport of American-style football alone. In addition, approximately 900 sports-related traumatic brain-injury deaths occur each year, and the risk of concussion is approximately 4 to 6 times higher in persons who have experienced previous concussions. Furthermore, younger athletes are at considerable risk as well. Although the level of play and corresponding collisions are less than those in adult sports, younger players are far less adept at protecting themselves, leading to multiple sever injuries.

Based upon the foregoing, a need exists for protective gear that will mitigate the incidence of head concussion and severe injury. So as to render the same available to the most athletes possible, a need exists for such an apparatus to be manufactured at a relatively low cost. Furthermore, there is a need for such improved gear to be adapted to helmets and equipment of all major sports and recreational activities, as well as additional activities requiring the usage of protective gear such as construction, police and military operations, and a host of other fields and applications.

As noted herein, past attempts to improve helmets and equipment to accomplish the desired objectives have largely involved varying the shape or configuration of the gear or modify the type of padding utilized by the same. However, such have not effectively shown a decrease in the incidence of concussion and serious injury, but have instead added to overall production costs.

It is respectfully submitted that the apparatus of the present invention is uniquely designed to mitigate this problem, as the absorption and dissipation of impact forces is greatly enhanced by the very placement of the pre-formed pads, as well as by the rigid or semi-rigid insert within them.

To provide one example of the utility of the present invention, there have been many reported cases of young boys suffering fatal injuries when hit in the chest area during sporting activity. The present invention is expected to greatly reduce the risk of this type of trauma, when the pre-formed pad with rigid or semi-rigid insert is applied to a chest protection device in the vicinity of the user's heart.

To provide a further example of the utility of the present invention, in the sport of hockey it is a known fact that the goal tender receives lacerations in their forehead from the continuous impacts from pucks hitting the facemask. The forehead area, in most instances, receives the primary force. The present invention will reduce the risk of injury by placing an above-mentioned pre-formed protective pad with rigid or semi-rigid insert just above and between the eyes to the forehead area. The pre-formed protective pad will reduce the risk of lacerations and head injuries to goal tenders in a manner previously unavailable.

As such, usage of the present invention adds minimal weight to the helmets or equipment, with no holes or modifications added to the helmets or equipment for effective attachment purposes. In addition, the added protective pads of the invention function to protect the equipment itself from damage, providing additional benefits to the user. Finally, the invention allows for increased safety and protection in a very inexpensive manner, one that can be manufactured and distributed with relative ease.

In summation, in light of the foregoing, it is an object of the present invention to provide improved protective pads that are lightweight and relatively inexpensive to manufacture.

It is a further object of the invention to provide pre-formed protective pads that are removable and generally convenient to attach to and detach from all helmets and protective equipment.

It is a further object to provide improved pre-formed protective pads that may be easily retrofitted to previously-existing helmets and protective devices, providing the benefits of the present invention to all current users of the same.

In addition, it is an object of the present invention to provide pre-formed protective pads that may alternatively be manufactured on new helmets and equipment for users who desire the benefits thereof.

It is a further aim of the invention to provide break-away type pads that conveniently attach to headgear and equipment without modification to the same, thus reducing the overall cost of manufacture.

It is a further goal of the invention to provide break-away type pads that attach to headgear and equipment without the usage of solid members, such as metal or plastic fasteners.

In addition, it is an object of the invention to provide break-away type pads that protect the most vulnerable areas of the body, with the remainder of previously-existing equipment protecting less critical areas.

It is a further object of the present invention to provide improved break-away type pads that help protect the helmets and equipment to which they are attached.

It is a further object of the invention to provide improved break-away type pads that are manufactured in a variety of previously determined sizes, so as to render the same effective for a host of sporting activities and additional applications where such protection is desired.

Another object of the invention is to provide an assembly wherein any damaged pad member may be quickly replaced, absent the need for complex tools and fasteners.

Finally, it is an object of the invention to provide break-away type pads that are manufactured in a variety of previously determined colors and designs, so as to either match the decor of the equipment upon which the same are utilized or indicate caution to observers thereof.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

As described herein, the present invention is an improved protective padding device. More particularly, the invention is a series of pre-formed pads that each include a rigid or semi-rigid insert for enhanced protection and effectiveness. In one mode of production, such rigid or semi-rigid layer is located within the pad, or covered by pliable pad material on all sides. In a second mode, the rigid or semi-rigid member appears on the exterior surface of the pad, with pliable materials located beneath. In still another mode, the rigid or semi-rigid member appears on the interior surface of the pad, providing great versatility to the manufacturer or user.

The aforementioned FIGURES depict varying embodiments of the pads of the present invention, to illustrate the versatility in design offered by the present invention without compromise to the effectiveness of the same. For the purposes of example only, all such FIGURES depict the improved pads of the present invention used in connection with protective headgear.

Figure 1:
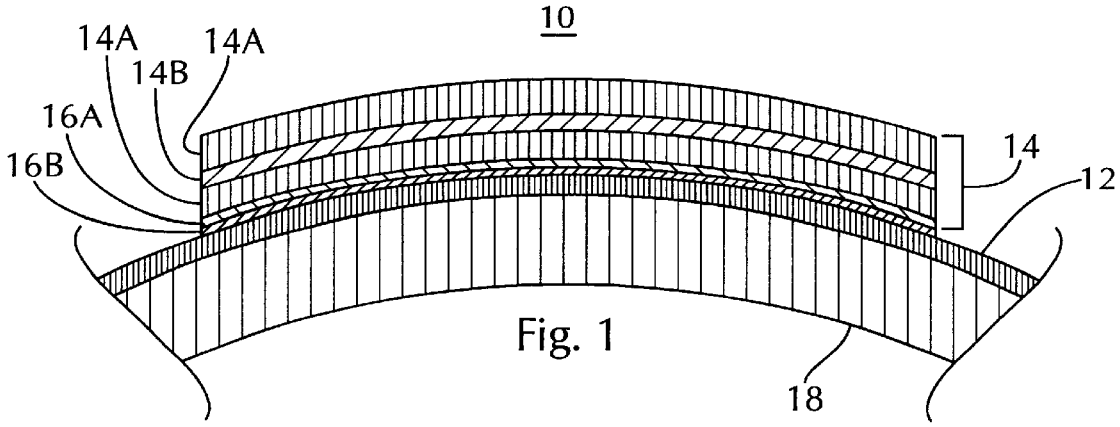
FIG. 1 is a cross-sectional view of the protective pad assembly of the present invention, illustrating the principal components and their general location of attachment in the preferred mode, wherein the rigid or semi-rigid insert appears within the pre-formed pad, sandwiched by soft pad material.

FIG. 1 is a cross-sectional view of the protective pad assembly of the present invention, illustrating the principal components and their general location of attachment in the preferred mode. Specifically, illustrated are: the pre-formed apparatus with rigid or semi-rigid insert (10), hard outer shell of helmet (12), detachable pre-formed pad (14), pre-formed pad soft material (14A), rigid or semi-rigid insert of present invention (14B), attachment means (pad portion) (16A), attachment means (helmet portion) (16B), and helmet interior padding (18). In this basic embodiment of the present invention, a single rigid or semi-rigid insert appears within the preformed pad, sandwiched by soft pad material towards both the interior and exterior of the pad.

Figure 2:
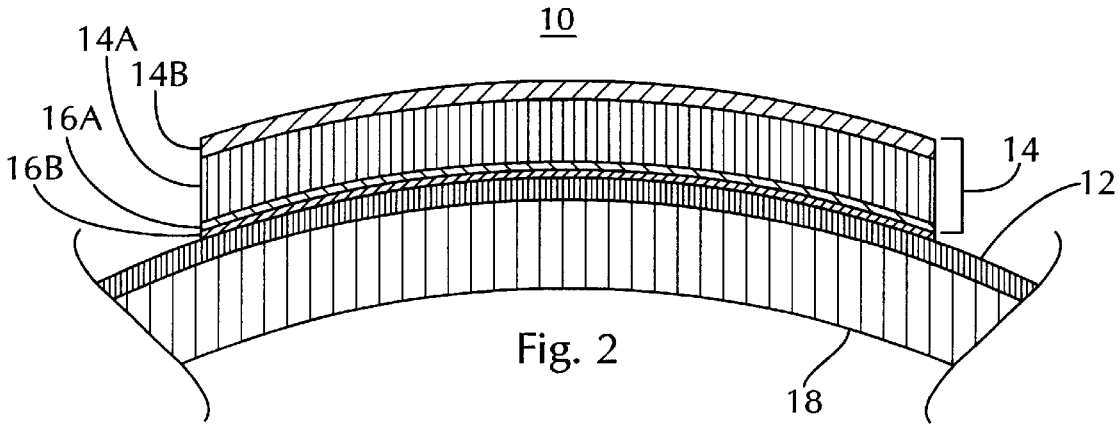
FIG. 2 is a cross-sectional view of the protective pad assembly of the present invention, wherein the rigid or semi-rigid insert appears upon the exterior surface of the pre-formed pad.

The next embodiment of the present invention is depicted in FIG. 2, which is a cross-sectional view of the protective pad assembly of the present invention, wherein the rigid or semi-rigid insert (14B) appears upon the exterior surface of the pre-formed pad (14). Such provides an additional layer of protection, as the rigid or semi-rigid member will function to receive forces much in the manner that the hard shell of a helmet.

Figure 3:
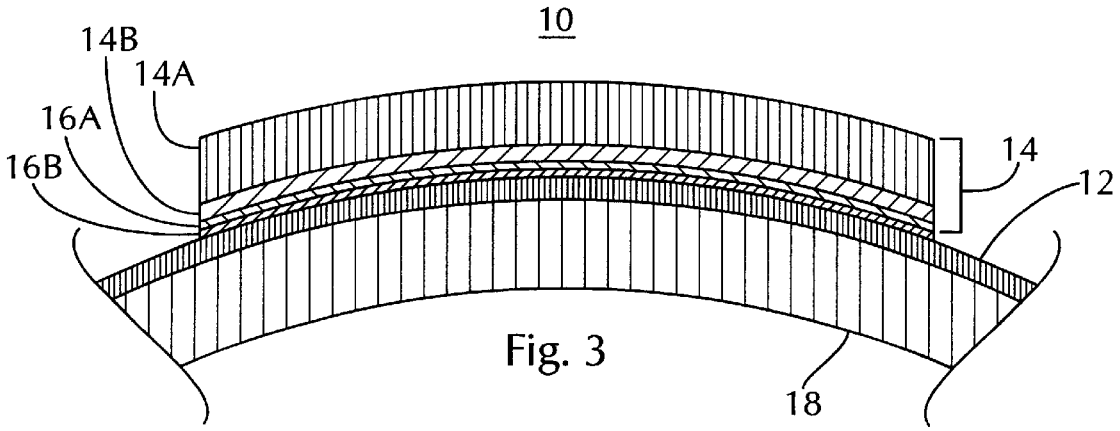
FIG. 3 is a cross-sectional view of the protective pad assembly of the present invention, wherein the rigid or semi-rigid insert appears upon the interior surface of the pre-formed pad.

For the purposes of versatility, an additional embodiment of the present invention is depicted in FIG. 3, which is a cross-sectional view of the protective pad assembly of the present invention, wherein the rigid or semi-rigid insert (14B) appears upon the interior surface of the pre-formed pad (14), also for enhanced reception and dissipation of forces to the protective gear.

Figure 4:
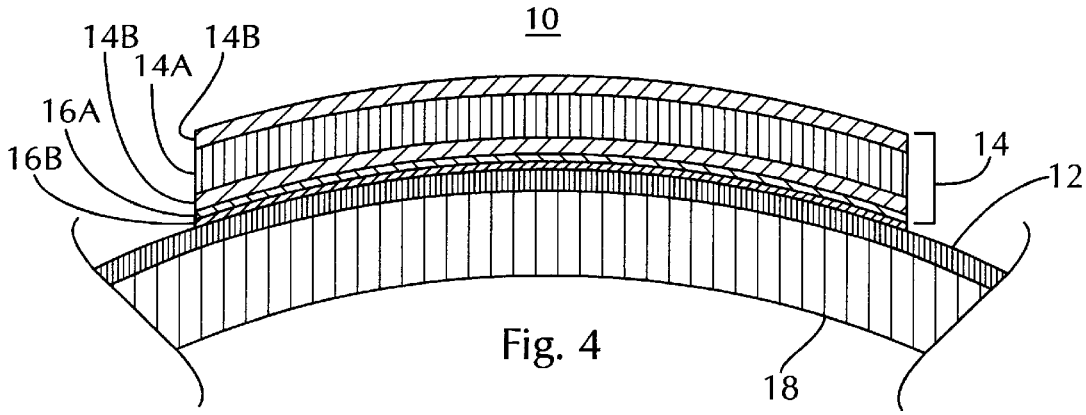
FIG. 4 is a cross-sectional view of the protective pad assembly of the present invention, in an alternate embodiment wherein multiple rigid or semi-rigid inserts appear upon both the exterior and interior surfaces of the pre-formed pad.

The next embodiment of the present invention is depicted in FIG. 4, which is a cross-sectional view of the protective pad assembly of the present invention, in an alternate embodiment wherein multiple rigid or semi-rigid inserts (14B) appear upon both the exterior and interior surfaces of the pre-formed pad (14). Thus, if desired, the manufacturer may produce a combination of the embodiments depicted in FIGS. 2 and 3 above, for the utmost in protection of the user.

Figure 5:
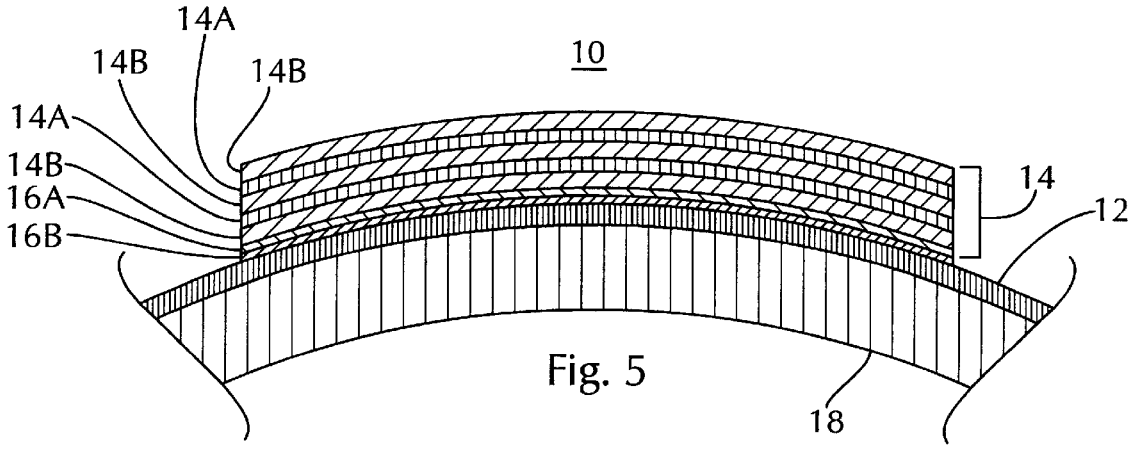
FIG. 5 is a cross-sectional view of the protective pad assembly of the present invention, in an alternate embodiment wherein multiple rigid or semi-rigid inserts appear within the pre-formed pad, each surrounded by soft pad material.

According to a similar theory, FIG. 5 is a cross-sectional view of the protective pad assembly of the present invention, in an alternate embodiment wherein multiple rigid or semi-rigid inserts (14B) appear within the pre-formed pad (14), each surrounded by soft pad material (14A). Such can be expected to provide even more enhanced protection, due to the "sandwiching" of a plurality of rigid or semi-rigid inserts (14B) within the pad itself.

Figure 6:
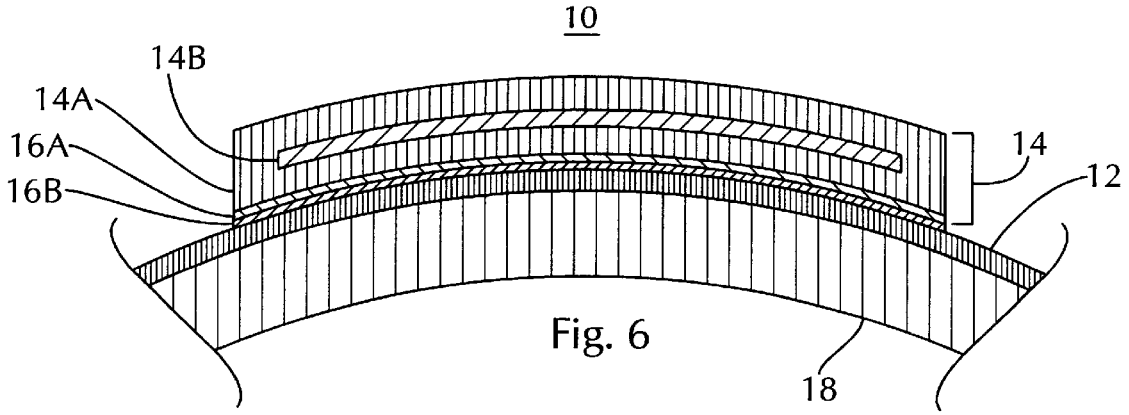
FIG. 6 is a cross-sectional view of the protective pad assembly of the present invention, in an embodiment similar to that in FIG. 1, however the rigid or semi-rigid insert appears completely within the pre-formed pad, entirely surrounded by soft pad material.

Finally, FIG. 6 is a cross-sectional view of the protective pad assembly of the present invention, in an embodiment similar to that in FIG. 1, however the rigid or semi-rigid insert (14B) appears completely within the pre-formed pad (14), entirely surrounded by soft pad material (14A). As distinguished from the embodiment depicted in FIG. 1, the sides or edges of the rigid or semi-rigid insert (14B) in this mode are not exposed, but are instead entirely encased within the softer traditional pad material (14A).

It should be noted that yet additional embodiments of the present invention may include a rigid or semi-rigid insert located either within the interior padding of such device as a helmet itself, or between the hard outer shell of the helmet and its interior padding. Such will naturally serve to enhance the overall protection of the gear, as forces thereto will be further dissipated prior to being absorbed by the user.

In relation to any of the above embodiments, the insert may be manufactured of a high-density polyethylene, low-density polyethylene, or semi-rigid material. The thickness of the insert may be one-sixteenth to three-eighths inches for helmet usage, and may be one-sixteenth to three-quarter inches for other equipment usage. In all instances, the rigid or semi-rigid insert functions to significantly improve the absorption and dissipation of primary forces directly into protective gear to better protect the user.

Importantly, the pads of the present invention may be applied to all forms of protective equipment, both in critical areas of injury and additional locations. For the purposes of example, such may be applied to the exterior of helmets, such as for sporting equipment, police, fire, or military usage. The pads may also be applied to items such as chest protectors in baseball, hockey, and other sports, as well as for shoulder pads, shin guards, knee pads, elbow pads, gloves, chin pads, and a host of additional protective devices. In total, the pads of the present invention provide greatly enhanced protection to all areas of the user, without adding significant weight or manufacturing costs to the protective gear utilized.

Importantly, a plurality of such improved pre-formed protective pad members may be removably attached to a pre-existing hard shell of a helmet along the exterior of the shell. Particularly, in the preferred mode, a plurality of pre-formed pad members comprises a left side pad, right side pad, front pad, back pad, and crown pad. Such pad locations are selected for the purposes of addressing the most critical areas of the head, in relation to incidence of trauma and concussion. Specifically, the above-listed pre-formed pad members affix to the hard shell at each temporal area, the frontal area, the rear or occipital area, and the crown or dome of the head. To adapt to the hard shell and interior pad, left side pad further comprises a left side pad aperture generally adjacent to a left ear of a user, and right side pad comprises a right side pad aperture at a right ear of the user. In the preferred mode of production, the attachment means comprises hook and loop fasteners, for convenience and simplicity of design and manufacture.

Generally, as described herein, the pre-formed pad members function to receive primary forces, with the hard shell or protective equipment receiving secondary forces. Next, the hard shell or equipment's interior padding receive additional forces, with only remaining dissipated forces distributed to the user. To accomplish this tailored objective, in preferred modes of manufacture, the pre-formed pad inserts are produced in a thickness of a range of one-sixteenth inch to three-quarter inch for usage in connection with protective equipment. In the preferred form of usage upon protective helmets for firefighters, police, and military personnel, the inserts are produced in a thickness of a range of one-sixteenth inch to three-eighths inch. However, other thicknesses of pre-formed pads may be utilized if desirable.

In all such cases, the pre-formed protective pads with inserts are manufactured in a variety of previously-determined sizes, functioning to render the pre-formed pads effective for multiple previously-determined sporting events and hazardous activities. Thus, the apparatus may be utilized for activities such as football, hockey, baseball, cycling, climbing, skateboarding, roller skating, or any other sporting activity. Importantly, the apparatus may be utilized for any additional hazardous activity requiring usage of protective gear, such as construction, military usage, and police and firefighting usage.

Moreover, the pre-formed pads may be manufactured in a variety of previously determined colors, designs, or reflective materials. Thus, such will function to both match a decor of a helmet upon which the pre-formed pads are utilized, and indicate caution to any observers, rendering the same even more desirable to the user.

It should further be noted that in one embodiment, the pre-formed protective pads are designed to release from the equipment when a force of a glancing blow to the apparatus exceeds a force of fastening attachment thereof. Such is an additional benefit to the assembly, as the removed pads may be easily replaced or re-installed at minimal expense.

In all embodiments, as noted, the pre-formed protective pads attach to the helmet or equipment without modification to the same. In fact, it should be noted that the pre-formed pads mitigate the incidence of cracking or damage to the equipment itself, preserving and prolonging the life of the gear to the benefit of its owner.

Finally, it bears repeating that the pre-formed protective pads described herein may be retrofitted to previously-existing helmets and protective equipment, or alternatively may be manufactured in connection with new helmets and protective equipment, providing the utmost in versatility to those in need of protective headgear.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by letters patent is set forth in the appended claims.

What is claimed is:

1. An improved protective apparatus comprising:

at least one pre-formed protective pad removably attached to an existing item of protective equipment, the pre-formed pad comprising a generally soft, pliable pad material, and further comprising at least one insert the pre-formed pad functioning to receive primary forces, with the existing item of protective equipment receiving secondary forces, existing item of protective equipment padding receiving additional forces, with only remaining dissipated forces distributed to the user.

2. The improved protective apparatus as described in claim 1, wherein the insert is located within the pre-formed protective pad, sandwiched by soft pliable pad material.

3. The improved protective apparatus as described in claim 1, wherein the insert is located upon an exterior surface of the pre-formed protective pad.

4. The improved protective apparatus as described in claim 1, wherein the insert is located upon an interior surface of the pre-formed protective pad.

5. The improved protective apparatus as described in claim 1, wherein the insert is located completely within the pre-formed protective pad, entirely surrounded by soft, pliable pad material on all sides thereof.

6. The improved protective apparatus as described in claim 1, wherein the pre-formed protective pad is manufactured in a variety of sizes.

7. The improved protective apparatus as described in claim 1, wherein the pre-formed protective pad is attached to the existing item of protective equipment by attachment means, the attachment means comprising, hook and loop fasteners.

8. The improved protective apparatus as described in claim 1, wherein the pre-formed protective pad members are retrofitted to previously-existing helmets.

9. The improved protective apparatus as described in claim 1, wherein the pre-formed protective pad members are retrofitted to previously-existing items selected from the group consisting of knee pads, elbow pads, shoulder pads, chest protectors, and shin guards.

10. The improved protective apparatus as described in claim 1, wherein the apparatus is utilized for activities selected from the group consisting of football, hockey, baseball, softball, lacrosse, skiing, horseback riding, climbing, skateboarding, roller skating, cycling, motorcycling, automobile racing, snowmobiling, construction, police usage, firefighting usage, and military usage.

11. The improved protective apparatus as described in claim 1, wherein the pre-formed protective pads are designed to release from the equipment when a force of a glancing blow to the apparatus exceeds a force of fastening attachment thereof.

12. The improved protective apparatus as described in claim 1, wherein the pre-formed pads attach to the equipment without modification to the equipment.

13. The improved protective apparatus as described in claim 1, wherein the pre-formed pads are manufactured in a variety of previously determined sizes, functioning to render the pre-formed pads effective for multiple previously determined sporting events and hazardous activities.

14. The improved protective apparatus as described in claim 1, wherein the pre-formed pads are manufactured in a variety of previously determined colors and designs, functioning to match a decor of equipment upon which the pre-formed pads are utilized.

15. The improved protective apparatus as described in claim 1, wherein the preformed pads bear a reflective material thereon, functioning to caution an observer thereof.

16. The improved protective apparatus as described in claim 1, wherein the pre-formed protective pads comprise at least one polymer material with retention memory characteristics, functioning to allow the pre-formed protective pads to deform upon receiving a force thereto and subsequently return to their original structure and thickness.

17. The improved protective headgear apparatus as described in claim 16, wherein the at least one polymer material is selected from the group consisting of polyurethane, a combination of polymers, and a combination of co-polymers.

18. The improved protective headgear apparatus as described in claim 16, wherein the at least one polymer material deforms in a manner directly proportional to the force received.

19. The improved protective headgear apparatus as described in claim 1, wherein the insert is located within a previously-existing helmet interior padding.

20. The improved protective headgear apparatus as described in claim 1, wherein the insert is located between a previously-existing helmet interior padding and helmet outer shell.

* * * * *